United States Patent [19]

Hanyu et al.

[11] 4,380,204

[45] Apr. 19, 1983

[54] NEEDLE AND FEED CAM ARRANGEMENT FOR A ZIG ZAG SEWING MACHINE

[75] Inventors: Susumu Hanyu, Hachioji; Akio Koide, Kokubunji, both of Japan

[73] Assignee: Janome Sewing Machine Co. Ltd., Tokyo, Japan

[21] Appl. No.: 235,136

[22] Filed: Feb. 17, 1981

[30] Foreign Application Priority Data

Feb. 20, 1980 [JP] Japan ..... 55-19737[U]

[51] Int. Cl.[3] ..... D05B 3/02

[52] U.S. Cl. ..... 112/158 A

[58] Field of Search ..... 112/158 A, 158 D, 158 R

[56] References Cited

U.S. PATENT DOCUMENTS

| | | | |
|---|---|---|---|
| 4,244,311 | 1/1981 | Sano | 112/158 A |
| 4,313,389 | 2/1982 | Hanyu et al. | 112/158 A |

FOREIGN PATENT DOCUMENTS

| | | | |
|---|---|---|---|
| 63270 | 9/1969 | Fed. Rep. of Germany | 112/158 A |
| 3011698 | 10/1980 | Fed. Rep. of Germany | 112/158 D |
| 303666 | 9/1968 | Sweden | 112/158 A |

*Primary Examiner*—Werner H. Schroeder
*Assistant Examiner*—Andrew M. Falik
*Attorney, Agent, or Firm*—Michael J. Striker

[57] ABSTRACT

A sewing machine includes a main drive shaft rotatably mounted in said housing for vertically reciprocating a needle penetrating a fabric to produce stitches therein, a shaft extending transverse to the main drive shaft and rotatably mounted in the machine housing, a worm and a worm gear between said main drive shaft and the transverse shaft for rotating the latter at a speed smaller than the rotational speed of the main shaft, a plurality of pattern cams and a plurality of feed control cams mounted on the transverse shaft for rotation therewith. The sewing machine is further provided with a transmission arrangement operatively connected to a needle arrangement frame and having a first follower adapted to cooperate with a selected one of the plurality of pattern cams for controlling lateral swinging movement of the needle, a fabric feed regulator tiltably mounted in the machine housing for regulating the amount of movement of the fabric to be stitched in forward and rearward direction, and the transmission device for controlling tilting of the feed regulator including a second follower cooperating with a selected one of the feed control cams. A control shaft with a pattern selecting cam and a feed selecting cam is mounted in the machine housing, which is operative for moving the first follower into cooperative engagement with a selected one of said pattern cams and for moving the second follower into cooperative engagement with a selected one of the feed control cams.

8 Claims, 11 Drawing Figures

NEEDLE AND FEED CAM ARRANGEMENT FOR A ZIG ZAG SEWING MACHINE

BACKGROUND OF THE INVENTION

The invention relates to a sewing machine provided with a mechanism for producing various stitch patterns by operation of a pattern selecting dial, and more particularly relates to an additional device operated to change the ratio of forward and backward feeding of the fabric with operation of the same pattern selecting dial by utilizing a mechanism for producing stitch patterns including a needle control cam and a feed control cam controlling the feeding movement of the fabric in the forward and backward direction in a predetermined amount.

For stitching a fabric of great elasticity, it is required to feed the fabric in the forward and backward directions repeatedly, generally with the approximate ratio of feeding amounts to 2.5:0.5. Such type of stitches is generally called the "outline stitches". However, in the conventional sewing machines, a feed control cam is generally designed to provide the feeding ratio of amount 2:1 in the forward and backward directions to produce the normally stitched patterns.

SUMMARY OF THE INVENTION

It is, therefore, an object of the invention to produce suitable outline stitches of the feeding ratio approximately 2.5:0.5 in the forward and backward directions especially by utilizing the feed control cam normally used for producing the patterns of stitches.

DETAILED DESCRIPTION OF THE INVENTION

Figure 1:
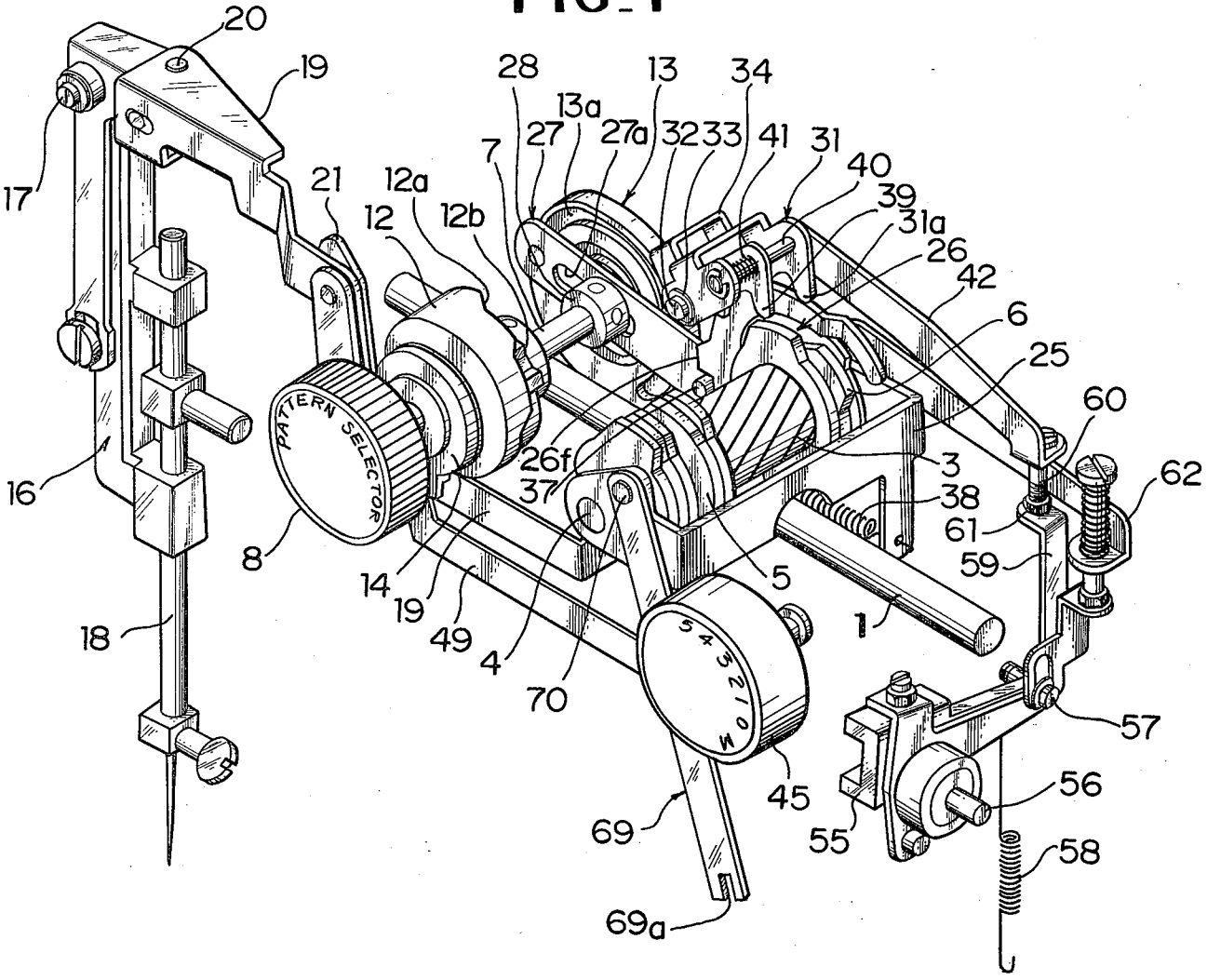
FIG. 1 is a perspective view of a sewing machine mechanism incorporated with the invention.
Figure 2:
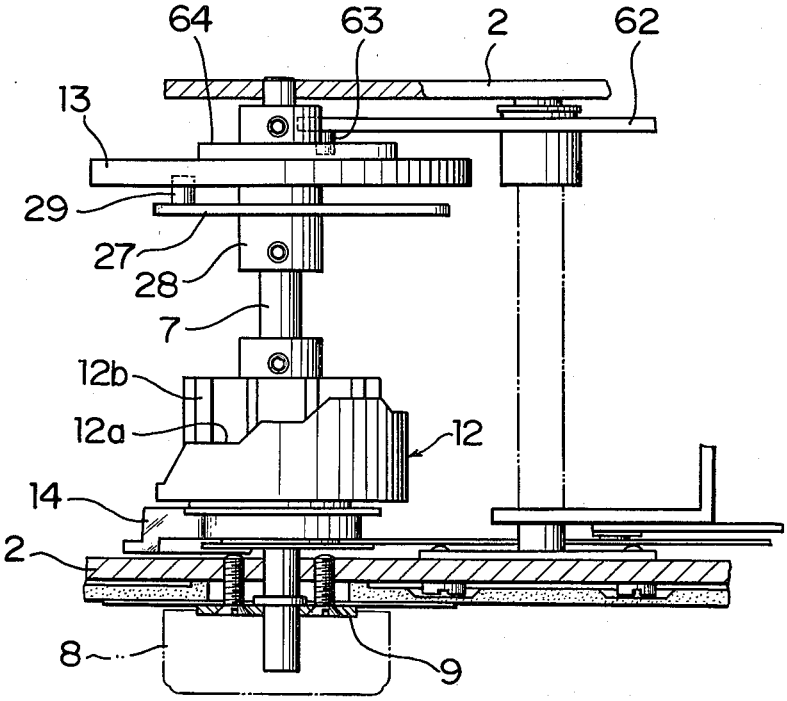
FIG. 2 is a plan view showing a pattern selecting part of the sewing machine mechanism of the invention.
Figure 3:
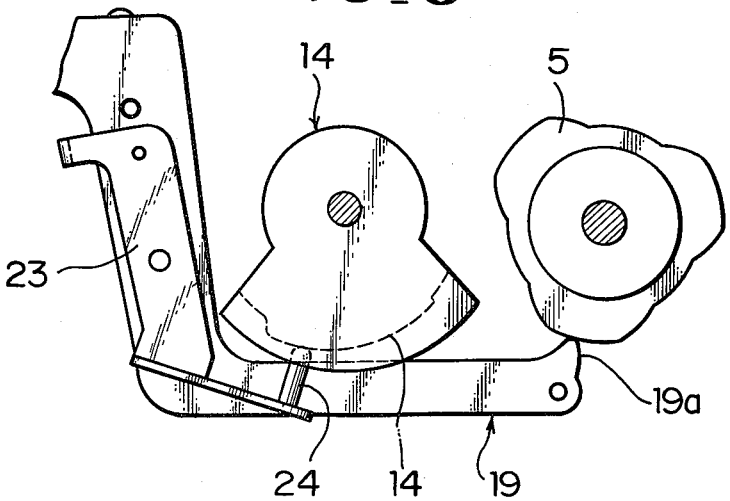
FIG. 3 is a front elevational view showing the pattern selecting part of the sewing machine mechanism.

In reference to FIGS. 1 and 2, main drive shaft 1 of the sewing machine is rotatably mounted on a machine housing 2. A worm 3 is mounted on a transverse shaft 4 secured to the machine housing 2. The worm 3 is in mesh with another worm (not shown) secured to the main drive shaft 1, and is designed to be rotated one revolution while the main drive shaft 1 rotates six revolutions. As shown, the worm is formed as a unit with a group of needle control cams 5 and a group of feed control cams 6.

Figure 7:
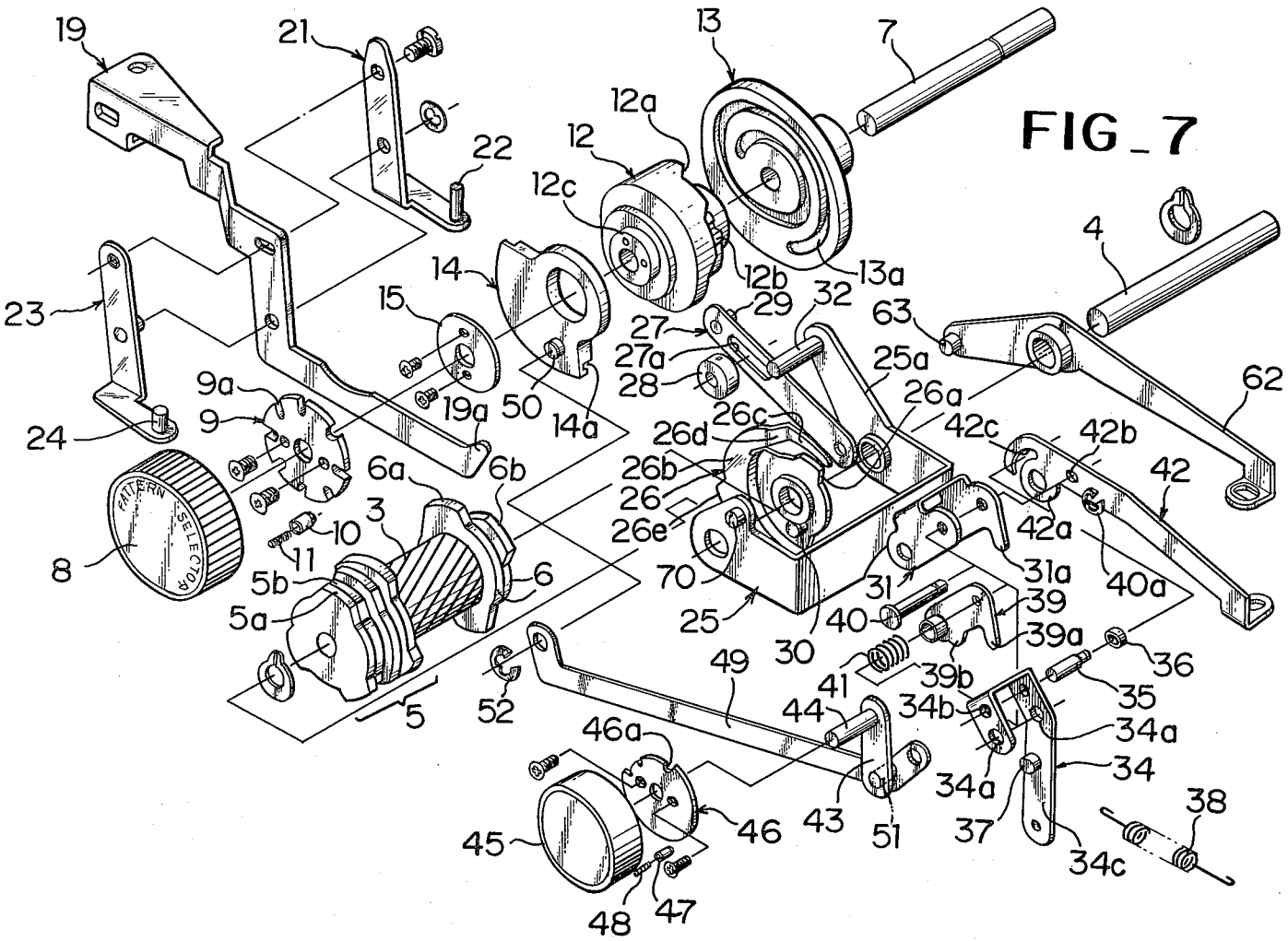
FIG. 7 is an exploded view of the sewing machine mechanism of the invention.

A control shaft 7 is turnably mounted transversely of the machine housing 2, one end of which protrudes out of the machine housing to support thereon an operating dial 8 for selecting patterns to be stitched. As shown in FIG. 7, the dial can be turned and held at a desired position defined by notches **9*a* of a disc 9 secured to the machine housing 2, by way of a pin 10 biased by a spring 11 towards the disc 9 between the dial 8 and the disc 9 and selectively engaged in one of the notches 9*a* as the dial 8** is turned.

Additionally in reference to FIG. 7, a pattern selecting cam 12 and a feed selecting cam 13 are secured to the control shaft 7. The pattern selecting cam 12 is formed with radially offset cam lifts **12*a* and axially offset cam lifts 12*b*. The feed selecting cam 13 is formed with a spiral cam groove 13*a* on one side thereof. A sector member 14 is turnably mounted on a boss 12*c* of the pattern selecting cam 12 with a washer 15 installed therebetween. The sector member 14 is provided with a projection 50 on one side thereof and is formed with a cam face 14*a*** on the other side thereof to be operated to regulate the lateral amplitude of the needle.

Figure 4:
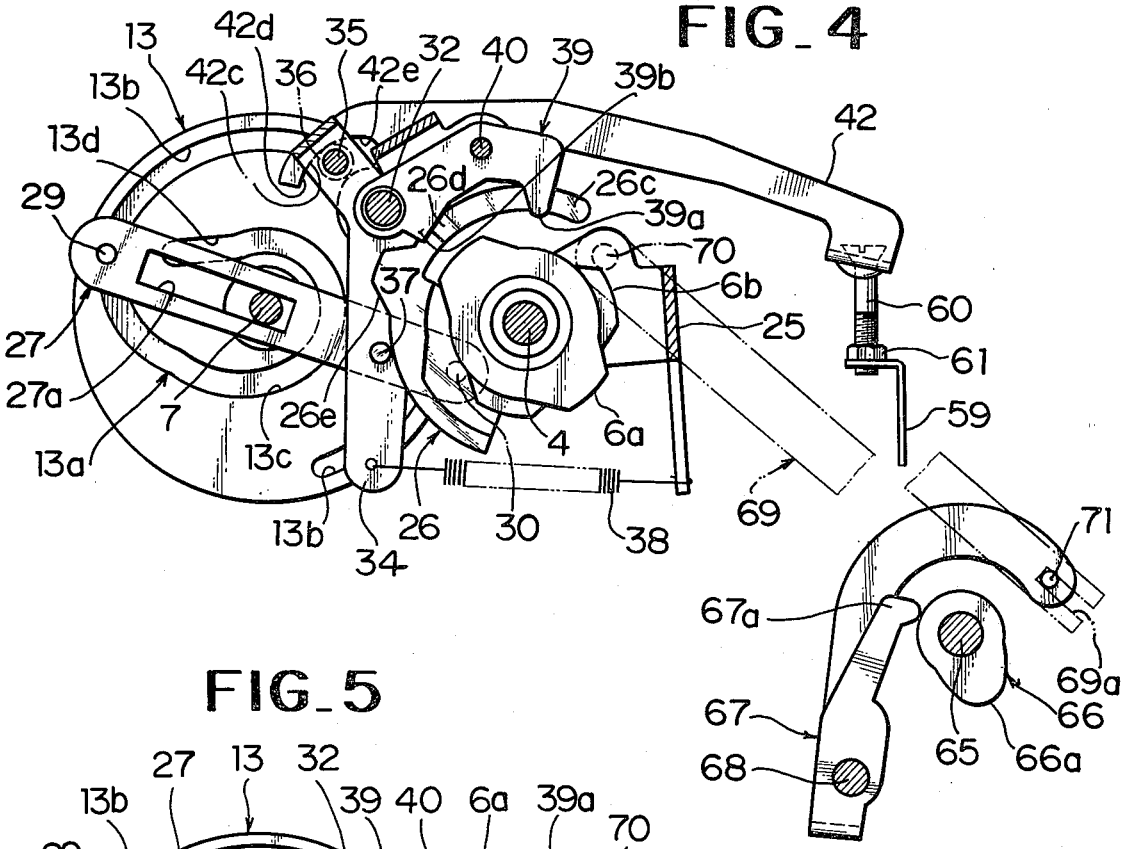
FIG. 4 is a front elevational view showing a feed control part of the sewing machine mechanism positioned in one operation phase.

As shown in FIG. 4, a switching rod 27 has a pin 29 provided at one end thereof and engaged in the spiral cam groove **13*a*. In the region of the cam groove 13 within the first complete revolution of the pattern selecting dial 8, the radially outer cam groove 13*b* displaces the rod 27 to the leftward position. On the other hand, within the second revolution of the pattern selecting dial 8, the radially inner cam groove 13*c* displaces the rod 27 to the rightward position. The radially inner end part 13*d* of the spiral cam face 13*a* is located between the radially outer cam face 13*b* and the radially inner cam face 13*c***, and is used to produce the outline stitches, the object to be obtained by this application.

As shown in FIG. 1, a frame 16 is at the upper end thereof swingably mounted on the maching housing 2. A needle bar 18 is supported on the swingable frame 16 and is vertically reciprocated. A transmission rod 19 is at one end turnably connected to a pivot 20 at the upper end 17 of the swingable frame 16 and is at the other end formed with a follower **19*a* to selectively engage the group of pattern cams 5. An arm 21 is secured to the transmission member 19 and has a pin 22 provided on one end thereof to engage the cam lifts 12*a*, 12*b* of the pattern selecting cam 12 for selectively engaging the cam follower 19*a* to the group of needle control or pattern cams 5 as the dial 8 is rotated, since the follower 19*a* is normally biased towards the pattern cams 5. Another arm 23 is secured to the transmission member 19 and has a pin 24 provided at the lower end thereof to engage the cam face 14*a* of the sector member 14 operated with regulate the lateral amplitude of the needle bar 18**.

A U-shape frame 25 is swingably mounted on the transverse support shaft 4 embracing the unit of worm 3, the groups of pattern cams 5 and feed control cams 6. A switching cam 26 is turnably mounted on the support shaft 4 within the U-shape frame 25. The switching cam 26 is formed with a releasing cam lift **26*a* and an arcuate extension providing a forward wall 26*b* and a rearward wall 26*c* connected to each other by a sloped face 26*d* and also providing a cam lift 26*e*. The aforementioned switching rod 27 is formed with an elongated opening 27*a* to allow the control shaft 7 to pass therethrough. A collar 28 is secured to the control shaft 7 to prevent the displacement of the switching rod 27 axially of the control shaft 7. The switching rod 27 has the other end connected to a pin 30 provided on one side of the switching cam 26**.

Figure 5:
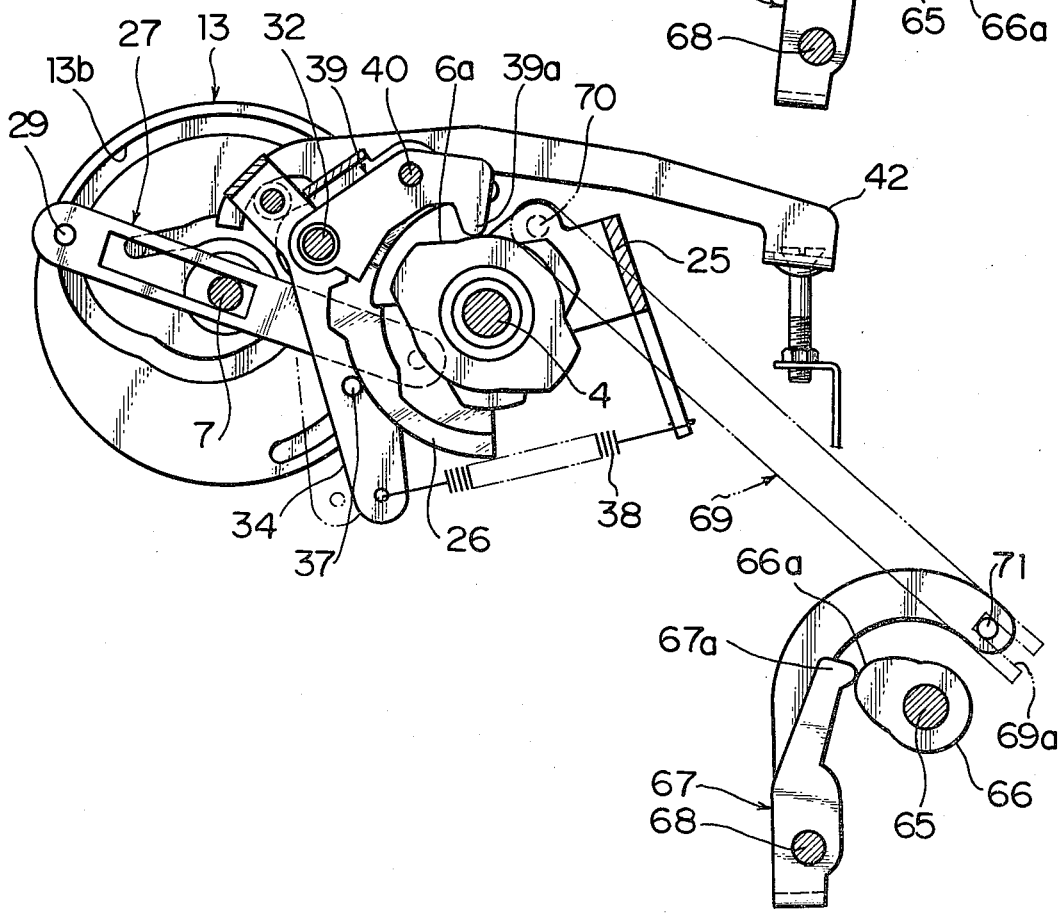
FIG. 5 is a front elevational view showing the feed control part positioned in another operation phase.

A U-shape arm 31 is at the lower end thereof turnably mounted on a pin 32 provided at the free end of the arm 25*a* of the U-shape frame 25 and is prevented from the displacement axially of the pin 32 by a washer 33. A U-shape lever 34 is at the lower holes 34*a* thereof turnably mounted on the pin 32 of the U-shape frame 25. A pin 35 is transversely mounted on the upper holes 34*b* of the U-shape lever 34. The pin 35 is at one end protruded out of the U-shape lever on one side thereof to support thereon a roller 36. The U-shape lever 34 has a lower extension 34*c* provided with a pin 37 at the intermediate part thereof. As shown in FIGS. 4 and 5, a tension spring 38 is at one end hanged to the lower end of the U-shape lever 34 and is at the other end anchored to the U-shape frame 25, so as to normally press the pin 37 of the U-shape lever 34 against the outer peripheral edge of the arcuate extension of the switching cam 26 where the cam lift 26*e* is formed.

A follower 39 is at the lower end thereof mounted on the pin 32 of the U-shape frame 25 within the U-shape arm 31 and the U-shape lever 34. The follower 39 is at the upper end thereof held by a pin 40 transversely mounted on the U-shape arm 31 as shown in FIGS. 1 and 7. The follower 39 is provided with an upper projection 39*a* to selectively engage the feed control cams 6 as will be mentioned hereinafter, and is provided with a lower projection 39*b*. The follower 39 is at the lower projection 39*b* normally pressed against the forward wall 26*b* or the rearward wall 26*c* of the switching cam 26 by a spring 41. The U-shape arm 31 has an upper projection 31*a* which is engaged by the cam lift 26*a* of the switching cam 26, so that the U-shape arm 31 may be disengaged from the feed control cam 6*a* or 6*b* when another feed control cam is selected.

Figure 9:
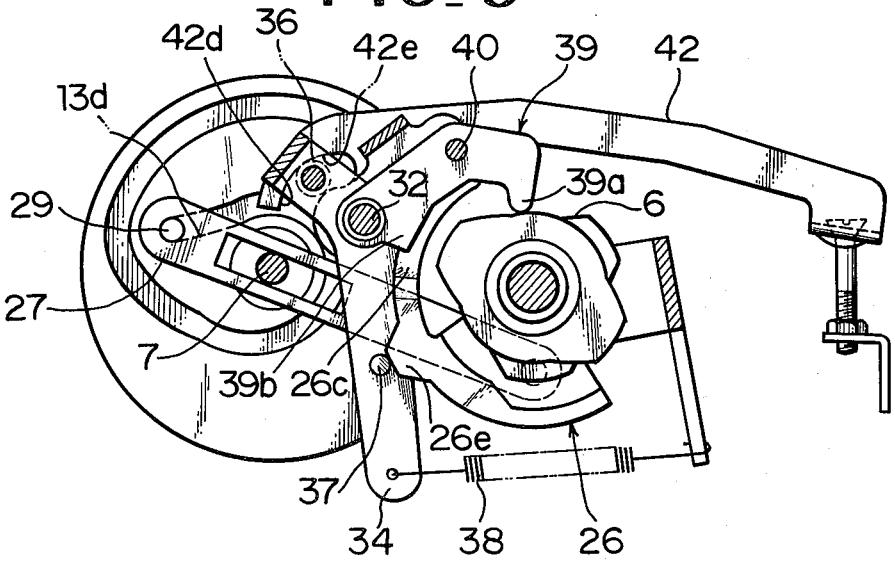
Figure 10:
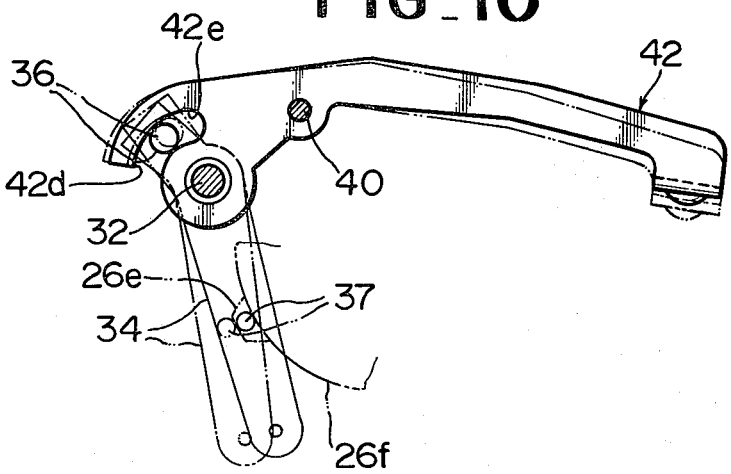

A feed transmission lever 42 is, at the opening 42*a* at one end part thereof, supported on the pin 32 of the U-shape frame 25, and is also, at the hole 42*b* provided on the right side of the opening 25, supported on one end of the transverse pin 40 protruded out of the U-shape arm 31 on the rear side thereof as shown. The feed transmission lever 42 has an arcuate slot 42*c* formed at one end thereof adjacent to the opening 42*a*. The arcuate slot 42*c* is, as shown in FIGS. 9 and 10, composed of a cam 42*d* substantially coaxial with the support pin 32 and an end cam 42*e* of a radius smaller than that of the cam 42*d*. The arcuate slot 42*c* is in engagement with the roller 36 provided on the side of the U-shape lever 34.

An operating dial 45 is secured to one end of a shaft 44 which is protruded out of the machine housing 2 and rotatably mounted on the machine housing 2. The dial 45 is selectively held at the angular positions thereof determined by the notches 46*a* formed around a disc 46 secured to the machine housing, since a pin 47 provided between the dial 45 and the disc 46 is normally pressed against the disc 46 by a spring 48, so that the pin 47 may be selectively inserted into the notches 46*a* as the dial 45 is rotated. An arm 43 is at the upper end secured to the inner end of the shaft 44. A transmission rod 49 is at one end connected to the lower end of the arm 43 and is at the other end connected to the pin 50 of the sector 14 by a washer 52. Thus the dial 45 is operated to determine the position of the follower 19*a* relative to the pattern cams 5 by way of the arm 23 having the pin 24 engaging the cam 14*a* of the sector 14, thereby to adjust the lateral amplitude of the needle bar.

In reference to FIG. 1, a feed regulator 55 as well known is swingably on a shaft 56 mounted to the machine housing 2. The feed regulator 55 is normally biased in the clockwise direction by a tension spring 58, and is connected to the other end of the feed transmission lever 42 through a pin 57, a vertical rod 59 and a screw 60 which is operated by a nut 61 to adjust the reference angular position of the feed regulator 55. A transmission lever 62 is at the intermediate thereof turnably mounted on the support shaft 4, and has a pin 63 provided at one end thereof for engaging a buttonhole control cam groove (not shown) formed on the other side of the feed selecting cam 13, and is at the other end operatively connected to the feed regulator 55. The description of the buttonhole mechanism is omitted herein because this is not the subject matter of this application.

In reference to FIGS. 4 and 5, a transverse shaft 65 is rotatably mounted on the machine housing 2 and is rotated by an operating dial (not shown) for selecting the feed control cams 6. A selecting cam 66 with a cam lift 66*a* is secured to the feed control shaft for rotation therewith. An arm 67 is at the lower end thereof swingably mounted on a pivot 68 secured to the machine housing 2. The arm 67 is formed with a follower 67*a* normally in engagement with the selecting cam 66 as shown. A pin 71 is provided at the upper end of the arm 67. A transmission rod 69 is at one end connected to a pin 70 (FIG. 7) provided on the U-shape frame 25 and is at the other forked end connected to the pin 71 of the arm 67.

Figure 6:
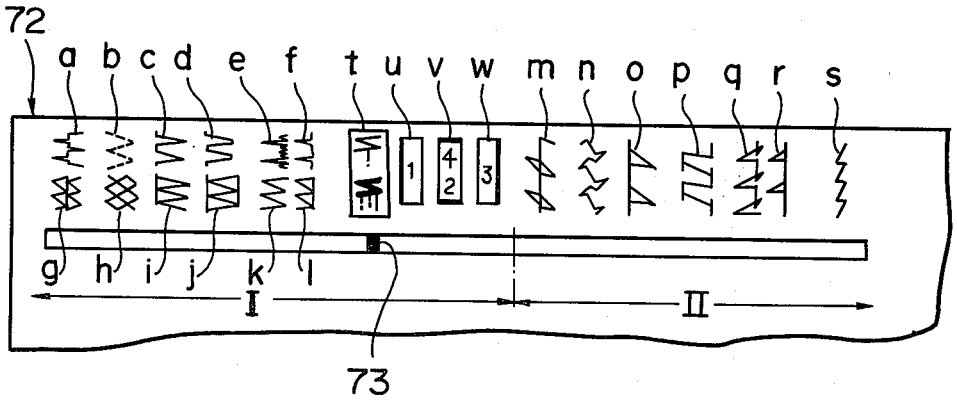
FIG. 6 is a front elevational view of a pattern indicating part of the sewing machine.

FIG. 6 shows a display plate arranged on the front face of the sewing machine, in which are indicated various patterns (a–s) to be selectively stitched. A pointer 73 is laterally moved to each of the patterns as the pattern selecting dial 8 is rotated to selectively stitch the same.

With the above mentioned structure of the invention, the operation is as follows; In reference to FIG. 4, if the pattern selecting dial 8 is rotated within the region of first revolution thereof as indicated by I in FIG. 6, the pin 29 of the switching rod 27 engages the radially outward cam 13*b* of the spiral cam groove 13*a* of feed selecting cam 13. The switching rod 27 is, therefore, displaced to the leftward position turning the switching cam 26 in the clockwise direction. In this condition, the follower 39 is pressed against the forward wall 26*b* of the switching cam 26. On the other hand, as the follower 67*a* of the arm 67 engages the radially reduced cam face of the selecting cam 66, the U-shape frame 25 is maintained in the horizontal position by the transmission rod 69. The follower 39 on the pin 32 is, therefore, held in the upper position and is disengaged from the feed control cam 6*a*. As is understood, as the pattern selecting cam 8 is rotated, the follower 19*a* is displaced relative to the pattern cams 5 and is engaged to one of the pattern cams 5 due to the action of the pattern selecting cam 12.

As shown in FIG. 5, if the selecting cam 66 is rotated and the radially enlarged cam lift 66*a* engages the follower 67*a*, the arm 67 turns in the counterclockwise direction, thereby to turn the U-shape frame 25 in the counterclockwise direction by way of the transmission rod 69. The pin 32 on the U-shape frame 25 is, therefore, displaced to the lower position from the upper position in FIG. 4. Thus the follower 39 is engaged with the feed control cam 6*a*, and the rotation of the feed control cam 6*a* is transmitted to the feed regulator 55 through the U-shape arm 31, the U-shape lever 34, the transmission lever 42 and the connecting rod 59, and thus the patterns (g–l) in FIG. 6 are selectively produced. In this case, the feed control cam 6a is designed to produce the ratio of feeding amount 1:1 in the forward and backward direction.

Figure 8:
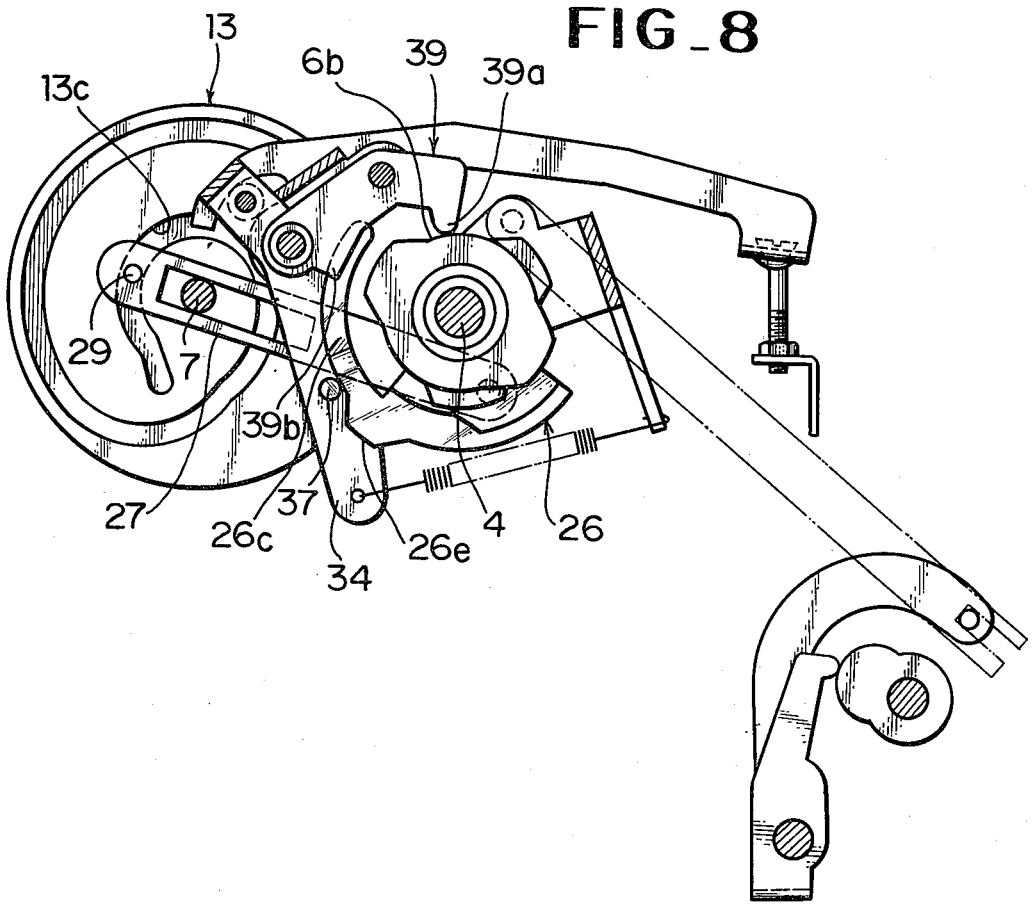
FIGS. 8–11 are explanatory operational representations of the invention.

As shown in FIG. 8, if the pattern selecting dial 8 is rotated into the region of second revolution as indicated by II in FIG. 6, the pin 29 of the switching rod 27 engages the radially reduced cam face 13c of the feed selecting cam 13. The switching rod 27 is, therefore, displaced to the rightward position, thereby to turn the switching cam 26 in the counterclockwise direction. As a result, the cam lift 26a (FIG. 7) of the switching cam 26 engages the follower part 31a of the arm 31, thereby to disengage the follower 39 from the feed control cam 6a. Simultaneously the follower 39 is displaced from the front wall 26b to the rearward wall 26c through the sloped guide face 26d and pressed against the rearward wall 26c by the action of the spring 41. With a further rotation of the pattern selecting dial 8, the cam lift 26a is disengaged from the arm 31, and the follower 39 is allowed to engage the feed control cam 6b. Thus the patterns (m–r) are selectively produced. In this case, the feed control cam 6b is designed to produce the ratio of feeding amount 2:1 in the forward and backward directions.

In FIG. 6, the pattern (t) and the pattern of buttonhole stitches (u, v, w) are produced when the pin 29 of the switching rod 27 engages the cam face between the radially enlarged cam face 13b and the radially reduced cam face 13c of the feed selecting cam 13. The description of this is omitted herein because this is not the subject matter of the invention.

If the pattern selecting dial 8 is further rotated in the same direction, the pin 29 of the switching rod 27 comes to engage the cam face 13d (for the outline stitching) of the selecting cam 13, thereby to turn the switching cam 26 in the clockwise direction from the position in FIG. 8 to the position in FIG. 9. Then the pattern selecting dial 8 is stopped, and the cam lift 26e of the switching cam 26 engages the pin 37 of the U-shape lever 34 thereby to turn the latter in the clockwise direction around the shaft 32. As a result, the U-shape lever 34 is displaced to the position shown by a broken line from the position shown by a solid line as shown in FIG. 10, and accordingly the roller 36 on the upper end of the U-shape lever 34 is displaced in the arcuate slot 42c of the transmission lever 42, resulting in reducing the backward feeding amount.

Figure 11:
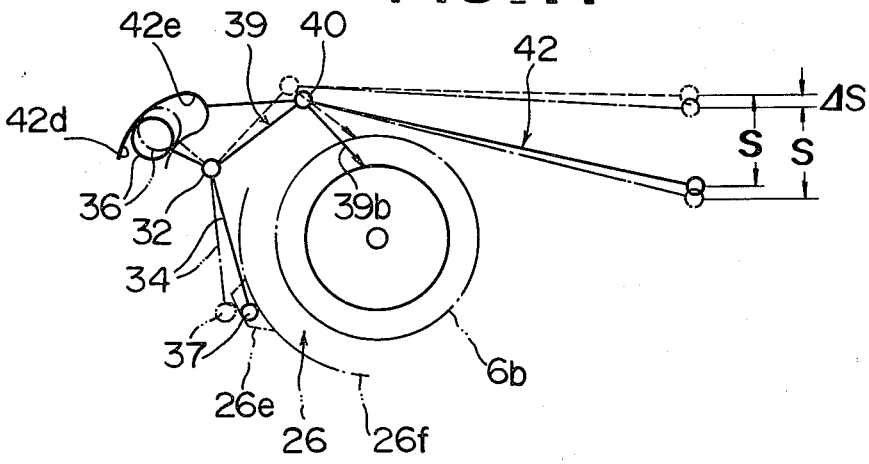

This is explained in reference to FIG. 11. Namely when the pin 37 of the U-shape lever 34 engages the arcuate edge 26f of the switching cam 26 as shown in the solid line, the roller 36 engages the cam 42d of the arcuate slot 42c, which is substantially coaxial with the pivot pin 32. In this condition, the transmission lever 42 is swingable with a stroke S between the solid line and the dotted line due to the cooperation of the follower 39 and the feed control cam 6b. On the other hand, when the pin 37 engages the cam lift 26e of the switching cam 26 as shown in the broken line, the roller 36 engages the cam 42e of the arcuate slot 42c, which is of a radius slightly smaller than that of the cam 42d relative to the pivot pin 32. In this condition, the swinging stroke S of the transmission lever 42 is downwardly displaced by the difference ΔS. This swinging stroke of the transmission lever 42 is transmitted to the feed regulator 55, and the latter is accordingly operated to increase the forward feeding amount and decrease the backward feeding amount resulting in the feeding ratio approximately 2.5:0.5. In this case, the basic zigzag pattern cam 5a is selected during the rotational operation of the pattern selecting dial 8 for setting the outline stitches. It is also required to adjust the lateral amplitude of the needle approximately to 1 mm by operation of the amplitude adjusting dial 45. Thus the outline stitches (S) as shown in FIG. 6 is produced.

We claim:

1. A sewing machine comprising a machine housing; a main drive shaft (1) rotatably mounted in said housing for vertically reciprocating a needle penetrating a fabric to produce stitches therein; a shaft (4) extending transverse to the main drive shaft and rotatably mounted in said housing; means (3) between said main drive shaft and the transverse shaft for rotating the latter at a speed smaller than the rotational speed of said main shaft; a plurality of pattern cams (5) and a plurality of feed control cams (6) mounted on said transverse shaft for rotation therewith; first transmission means (19) operatively connected to said needle and having a first follower (19a) adapted to cooperate with a selected one of said plurality of pattern cams for controlling lateral swinging movement of the needle; fabric feed regulator means (55) tiltably mounted in said housing for regulating the amount of movement of the fabric to be stitched in forward and rearward direction; second transmission means (42, 42d, 42e) for controlling tilting of said feed regulator means, said second transmission means being operatively connected to said feed regulator means and including a second follower (39) adapted to cooperate with a selected one of said plurality of feed control cams; and manually adjustable selecting means (8, 7, 12, 13, 14) cooperating with said first and said second transmission means for moving said follower of said first transmission into cooperative engagement with a selected one of said pattern cams (5) and for moving said follower (39) of said second transmission means into cooperative engagement with a selected one of said feed control cams (6).

2. A sewing machine as defined in claim 1, wherein said means between said main drive shaft and said transverse shaft comprises a worm (4) fixed to one of said shafts for rotation therewith and a worm gear meshing with said worm and fixed to the other of said shafts for rotation therewith.

3. A sewing machine as defined in claim 1, and including a needle frame (16) mounting the needle for vertical reciprocation and being mounted at one end thereof in said housing for pivotal movement about a pivot axis extending parallel to said transverse shaft.

4. A sewing machine as defined in claim 3, wherein said first transmission means comprises an elongated transmission member (19) connected at one end to said needle frame, said first follower (19a) being located at the other end of said transmission member.

5. A sewing machine as defined in claim 4, wherein said manually adjustable selecting means comprise a control shaft (7) turnably mounted in said housing parallel to said transverse shaft and projecting with an end thereof beyond said housing, an operating dial (8) fixed to said end of said control shaft for turning the latter, a pattern selecting cam (12) and a feed selecting cam (13) mounted on said control shaft for turning therewith and a sector member (14) coaxially mounted on said pattern selecting cam.

6. A sewing machine as defined in claim 5, wherein said pattern selecting cam is provided with radially offset cam faces (12a) and axially offset cam faces (12b)

and said sector member (14) with a radially offset cam face (14*a*), and wherein said selecting means further comprise first arm means (21) fixed to said transmission member (19) of said first transmission means and having a follower pin (22) arranged for cooperation with said cam faces of said pattern selecting cam for moving the follower at the other end of said transmission member into cooperative engagement with a selected pattern cam and second arm means (23) having a follower pin (24) arranged for cooperation with said cam face of said sector member and controlling the position of said first follower with regard to the selected pattern cam.

7. A sewing machine as defined in claim 5, wherein said feed selecting cam (13) is provided with a spiral cam groove (13*a*) and wherein said selecting means further comprise a switching cam turnably mounted on said transverse shaft (4), means (27, 29) engaging said spiral cam groove of said feed selecting cam and connected to said switching cam for turning the latter upon turning of said feed selecting cam, said switching cam having axially offset cam faces cooperating with said follower (39) of said second transmission means to bring said follower upon turning of said feeding selecting cam into a position to cooperate with the selected one of said feed control cams.

8. A sewing machine as defined in claim 7, wherein said second follower (39) is tiltably mounted on a pivot pin (32) parallel to said transverse shaft, and wherein said second transmission means further comprise a feed transmission lever (42) tiltably mounted intermediate its ends on said pivot pin, said feed transmission lever being operatively connected at one end to said feed regulator means (55) and provided in the region of its other end with a cam groove having successive cam portions (42*d*, 42*c*) extending at different radii from the axis of said pivot pin, said switching cam having further a peripheral surface (26*f*) and a radially extending cam portion 26*e* projecting from said peripheral surface and said spiral groove (13*a*) of said feed selecting cam having a substantially radially extending inner end portion (13*d*), a roller (36) engaging in said cam groove of said feed transmission lever, means (34) operatively connected to said second follower (39) and carrying said roller turnable about an axis parallel to said pivot pin, said last-mentioned means having a pin (37) riding on said peripheral surface (26*f*) of said switching cam and engaging said radially extending cam portion of the latter when said means engaging said spiral cam groove engages, upon turning of said feed selecting cam, said inner cam end portion of said spiral cam groove so as to move said roller from one to the other of said successive cam portions of said cam groove of said feed transmission lever to thereby vary the swinging movement of the latter and therewith that of said feed regulator.

* * * * *